US008403445B2

(12) United States Patent
Iwasaki

(10) Patent No.: US 8,403,445 B2
(45) Date of Patent: Mar. 26, 2013

(54) METHOD AND APPARATUS FOR DETERMINING THE DENSITY UNEVENNESS IN AN INK JET HEAD

(75) Inventor: Tadashi Iwasaki, Hachioji (JP)

(73) Assignee: Riso Kagaku Corporation, Tokyo (JP)

( * ) Notice: Subject to any disclaimer, the term of this patent is extended or adjusted under 35 U.S.C. 154(b) by 371 days.

(21) Appl. No.: 12/796,826

(22) Filed: Jun. 9, 2010

(65) Prior Publication Data

US 2010/0315457 A1 Dec. 16, 2010

(30) Foreign Application Priority Data

Jun. 11, 2009 (JP) ..... 2009-140168

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

2003/0086100 A1* 5/2003 Yashima et al. ..... 358/1.8
2005/0260004 A1* 11/2005 Maebashi et al. ..... 399/15

FOREIGN PATENT DOCUMENTS

JP 2001-92966 A 4/2001

* cited by examiner

*Primary Examiner* — Laura Martin
(74) *Attorney, Agent, or Firm* — Holtz, Holtz, Goodman & Chick, P.C.

(57) ABSTRACT

An apparatus for determining the density unevenness of an ink jet head includes a characteristic data generation unit which calculates characteristic values about ink amounts ejected from all nozzles of the ink jet head, respectively. A decision parameter acquisition unit arranges the characteristic values in the order the nozzles are arranged and calculates a decision parameter from changes in the characteristic values about those of the nozzles, which exist in a predetermined section. A decision unit compares the decision parameter with a predetermined threshold value, thereby determining the density unevenness of the ink jet head.

20 Claims, 11 Drawing Sheets

METHOD AND APPARATUS FOR DETERMINING THE DENSITY UNEVENNESS IN AN INK JET HEAD

CROSS-REFERENCE TO RELATED APPLICATIONS

This application is based upon and claims the benefit of priority from prior Japanese Patent Application No. 2009-140168, filed Jun. 11, 2009, the entire contents of which are incorporated herein by reference.

BACKGROUND OF THE INVENTION

1. Field of the Invention

The present invention relates to a method and apparatus for determining the density unevenness that is specific to any ink jet head.

2. Description of the Related Art

Any ink jet printer has an ink jet head that has a plurality of nozzles arranged in a line and configured to eject, for example, ink. In the ink jet printer, a recording medium is transported in a direction perpendicular to the line in which the nozzles of the ink jet head are arranged. The ink head ejects ink to the recording medium so transported, and forms an image on the recording medium. One of the various types of ink jet printers is a line head printer (i.e., one-pass line head printer), in which a recording medium is transported below the ink jet head one time, thereby to form an image on the recording medium.

In the ink jet head, the nozzles eject ink in different volumes (or amounts). That is, the amount of ink ejected from each nozzle differs that of ink ejected from any other nozzle. The difference in the amount of ink injected lowers the quality of the image formed on the recording medium in most cases. Particularly, the one-pas line heat printer may have inconvenience that results from, for example, the degrading of image quality. It is therefore useful to determine the difference between the nozzles in terms of the amount of ink ejected, in order to distinguish a good ink jet head from a defective one.

As a method of determining the difference between the nozzles of an ink jet head in terms of the amount of ink ejected, the method disclosed in, for example, Jpn. Pat. Appln. KOKAI Publication No. 2001-092966 can be utilized. The publication discloses a method of detecting streaks on a sheet-shaped object. The publication discloses an algorithm of comparing a plurality of line data items, one with another, and regarding any data item that changes more than a predetermined value, as a data time that represents an uneven streak.

BRIEF SUMMARY OF THE INVENTION

A method of determining the density unevenness of an ink jet head according to a first aspect of the present invention comprises calculating characteristic values about ink amounts ejected from all nozzles of the ink jet head, respectively; arranging the characteristic values in the order the nozzles are arranged and calculating a decision parameter from changes in the characteristic values about those of the nozzles, which exit in a predetermined section; and comparing the decision parameter with a predetermined threshold value, thereby determining the density unevenness of the ink jet head.

An apparatus for determining the density unevenness of an ink jet head according to a second aspect of the present invention comprises a characteristic data generation unit configured to calculate characteristic values about ink amounts ejected from all nozzles of the ink jet head, respectively; a decision parameter acquisition unit configured to arrange the characteristic values in the order the nozzles are arranged and to calculate a decision parameter from changes in the characteristic values about those of the nozzles, which exit in a predetermined section; and a decision unit configured to compare the decision parameter with a predetermined threshold value, thereby determining the density unevenness of the ink jet head.

DETAILED DESCRIPTION OF THE INVENTION

A first embodiment of this invention will be described with reference to the accompanying drawings.

Figure 1:
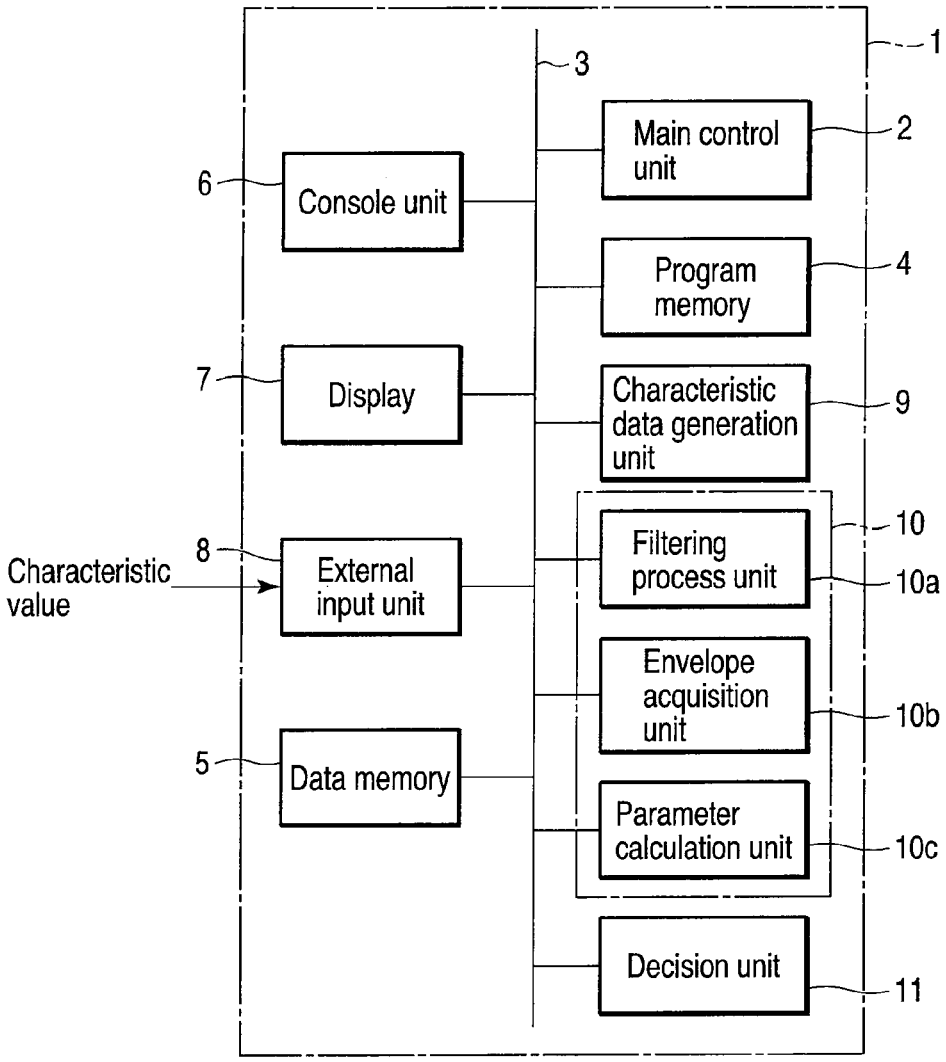
FIG. 1 is a block diagram showing an apparatus according to a first embodiment of this invention, which is designed to determine density unevenness of an ink jet head.
Figure 2:
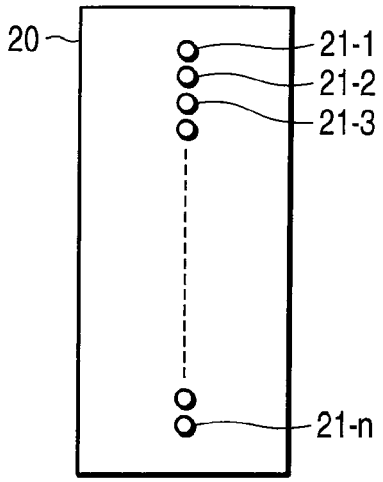
FIG. 2 is a diagram showing the nozzles arranged in a line in the ink jet head inspected by the apparatus.

FIG. 1 is a block diagram showing an apparatus 1 according to the first embodiment of the invention, which is designed to determine density unevenness of an ink jet head. The apparatus 1 has a main control unit 2 constituted by, for example, a CPU. To the main control unit 2, a program memory 4, a data memory 5, a console unit 6, a display 7 and an external input unit 8 are connected by a bus 3. The console unit 6 is composed of, for example, a keyboard and a mouse. The display 7 is, for example, a liquid crystal display. The external input unit 8 inputs various data items through a communication line etc. The various data items are, for example, characteristic values about the amounts of ink ejected from the nozzles 21-1 to **21-*n* provided in, for example, such an ink jet head 20 as shown in FIG. 2. The data memory 5 temporarily stores the data that has been processed in accordance with the instructions issued from the main control unit 2**.

The program memory 4 stores a density-unevenness determination program for determining the density unevenness that is specific to the ink jet head 20. The density-unevenness determination program is used to generate characteristic values about the ink amounts to eject from all nozzles 21-1 to **21-*n* of the ink jet head 20, to arrange all characteristic values in the order the nozzles 21-1 to 21-*n* are arranged, to calculate decision parameters from the differences between some of the characteristic values so arranged, and to compare the decision parameters, thus calculated, with a predetermined threshold value. The density unevenness specific to the ink jet head 20** is thereby determined.

The main unit 2 executes the density-unevenness determination program stored in the program memory 4, controlling a characteristic data generation unit 9, a filtering process unit **10*a*, a parameter calculation unit 10*c* and a decision unit 11**.

The characteristic data generation unit 9 calculates characteristic values about the ink amounts to eject from all nozzles 21-1 to **21-*n* of the ink jet head 20. More specifically, the characteristic data generation unit 9** generates one data item selected from the group consisting of the ink amount ejected from each nozzle, the diameter of the ink drop ejected from the nozzle, the diameter of ink dot formed as the ink ejected lands a recording medium, the area of the ink dot, the optical density of the ink dot, the diameter of the nozzle, the resistance or electrostatic capacitance of the actuator that ejects the ink through the nozzle and the size of the nozzle.

Figure 6:
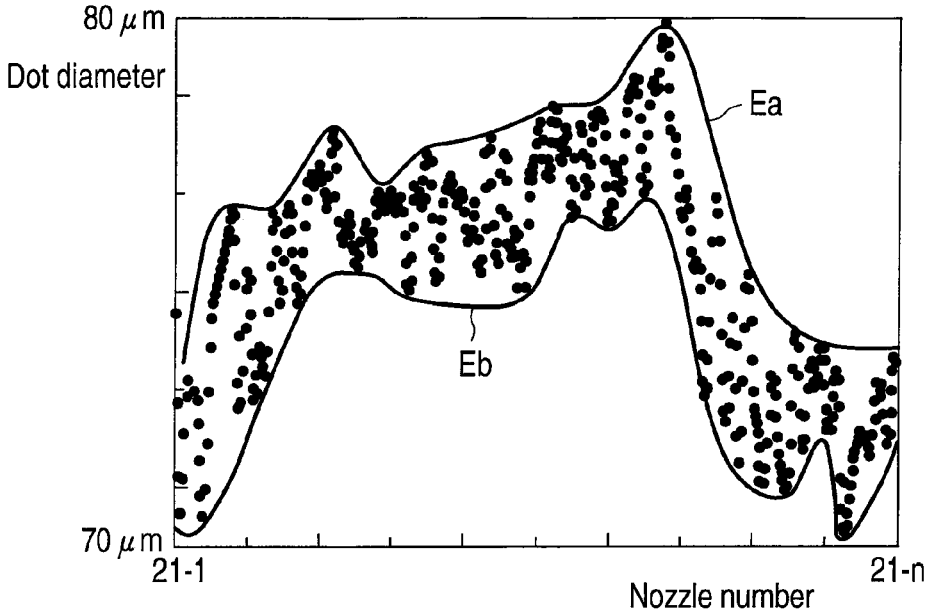
FIG. 6 is a diagram showing the first and second envelopes acquired by the envelope acquisition unit provided in the apparatus.
Figure 7:
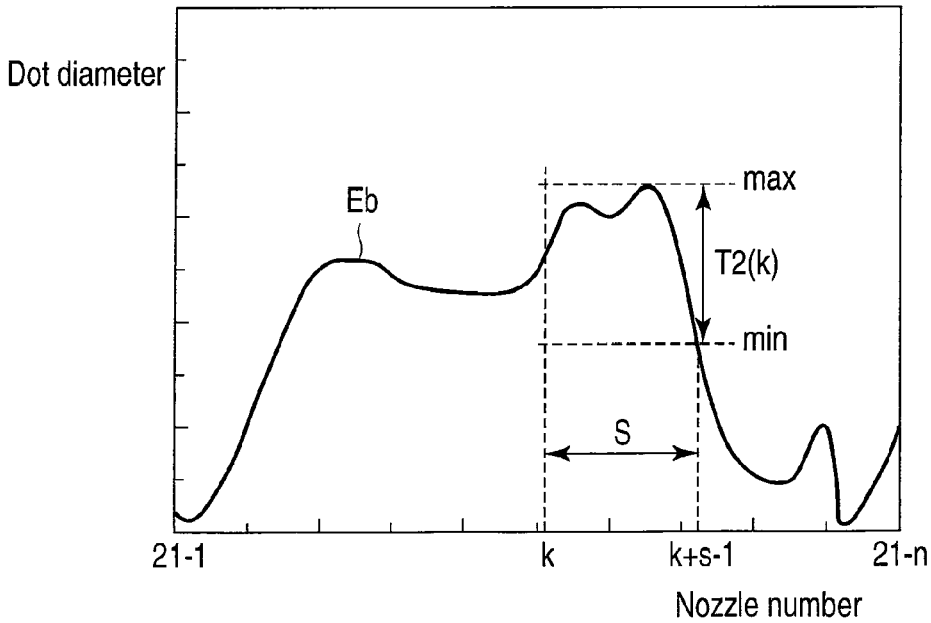
FIG. 7 is a diagram explaining how the parameter acquisition unit provided in the apparatus acquires decision parameters.

The apparatus 1 has a decision parameter acquisition unit 10. The decision parameter acquisition unit 10 prepares such a characteristic graph as shown in FIG. 6, by arranging the characteristic values calculated for the nozzles 21-1 to **21-*n* by the characteristic data generation unit 9, in accordance with the order the nozzles 21-1 to 21-*n* are arranged. The characteristic graph, thus prepared, shows how the dot diameter changes in accordance with the position of the nozzle. The nozzles of the ink jet head 20 are assigned to nozzle numbers "21-1" to "21-*n*," respectively, in accordance with the order they are arranged. As seen from in FIG. 7, the decision parameter acquisition unit 10 first scans a section S preset in the characteristic graph (hereinafter called "decision section S," in the direction in which the nozzles 21-1 to 21-*n* are arranged, and then acquires a decision parameter on the basis of the largest change in each characteristic value existing in the decision section S. The decision section S extends in the direction the nozzles 21-1 to 21-*n* are arranged, and has a width that corresponds to only some of all characteristic values. For example, the decision section S has a width corresponding to nozzle numbers "k" to "k+s−1." FIG. 7 shows how the dot diameter changes in only the second envelope Eb for the minimum dot diameter, not showing the first envelope Ea. As shown in FIG. 1, the decision parameter acquisition unit 10 has a filtering process unit 10*a*, an envelope acquisition unit 10*b*, and a parameter calculation unit 10*c***.

The filtering process unit **10*a* performs a filtering process on the characteristic values the characteristic data generation unit 9** has acquired about all ink amounts, for example the characteristic values about the density unevenness resulting from asymmetry, thereby accomplishing smoothing.

The envelope acquisition unit **10*b* acquires envelopes that accord with the changes that the respective characteristic values processed by the filtering process unit 10*a* have undergone. To be more specific, the envelope acquisition unit 10*b* acquires such two envelopes Ea and Eb as shown in FIG. 6**. These envelopes Ea and Eb accord with the largest and smallest changes, respectively, in the various characteristic values such as dot diameter.

The parameter calculation unit **10*c* scans the decision section S in the direction the nozzles 21-1 to 21-*n* are arranged, with respect to one of the envelopes Ea and Eb acquired by the envelope acquisition unit 10*b* as shown in FIG. 7. As it scans the envelope Ea or Eb, the parameter calculation unit 10*c* detects the largest change in the characteristic value. Then, the parameter calculation unit 10*c*** calculates a decision parameter from the largest change in the characteristic value.

The decision unit 11 compares the decision parameter calculated by the parameter calculation unit **10*c*, with the predetermined threshold value, thus determining the degree of the density unevenness specific to the ink jet head 20**.

How the density unevenness of the ink jet head 20 is determined will be explained with reference to the flowchart of FIG. 3.

The apparatus 1 determines the density unevenness in four steps M1 to M4. In Step M1, the characteristic value about the density unevenness of the ink jet head 20 is generated, in order to determine whether the apparatus 1 is a good ink jet head or a defective one. In Step M2, the characteristic value is subjected to the filtering process. In Step M3, a decision parameter is calculated from the characteristic value subjected to the filtering process. In Step M4, the degree of the density unevenness specific to the ink jet head 20 is determined from the decision parameter.

These steps will be described in the order they are performed.

In Step M1, the characteristic data generation unit 9 generates characteristic values about the ink amounts ejected from all nozzles 21-1 to **21-*n* of the ink jet head 20. The characteristic value pertaining to each of the nozzles 21-1 to 21-*n*** is one data item selected from the group consisting of the ink amount (mass or amount) ejected from the nozzle, the diameter of the ink drop ejected from the nozzle, the diameter of ink dot formed as the ink ejected lands a recording medium, the area of the ink dot, the optical density of the ink dot, the diameter of the nozzle, the resistance or electrostatic capacitance of the actuator that ejects the ink through the nozzle and the size of the nozzle.

Figure 4:
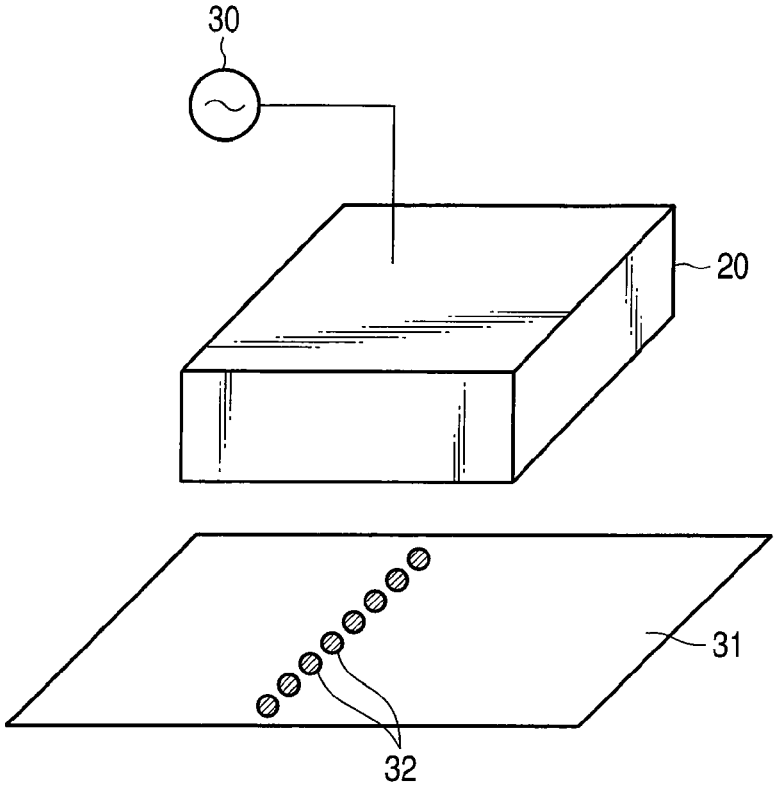
FIG. 4 is a schematic diagram explaining how the ink jet head performs test printing.

FIG. 4 is a schematic diagram explaining how the ink jet head 20 performs test printing. The ink jet head 20 has, in the bottom, a plurality of nozzles 21-1 to **21-*n*, for example in number NZL. The ink jet head 20 is an ink jet head of on-demand type. The ink jet head 20 has actuators of, for example, piezoelectric type or thermal type. The ink jet head 20 further has channels connected to the nozzles 21-1 to 21-*n*, respectively. Each channel contains ink. The actuators are provided on the walls of the channels connected to the respective nozzles 21-1 to 21-*n*. A recording medium 31 is placed, opposing to the ink jet head 20**.

In the ink jet head 20, each actuator contracts and expands in response to an external signal 30 supplied from an external apparatus. The actuators are provided on the channels of the nozzles 21-1 to **21-*n*, respectively, which are configured to eject ink. As each actuator contracts and expands, the pressure changes in the channel on which the actuator is provided. As a result, the ink contained in the channel is ejected from the nozzle (nozzle 21-1, 21-2, . . . or 21-*n*). The ink ejected from each nozzle forms a test dot 32 on the recording medium 31**.

In most cases, the density unevenness specific to the ink jet head 20 largely results from the difference between the nozzles 21-1 to **21-*n* in terms of the amount of ink ejected, or the difference between the nozzles 21-1 to 21-*n*** in terms of the angle at which ink is ejected.

In the present embodiment, the difference in amount of ink ejected is evaluated. The characteristic value for evaluating the difference in amount of ink ejected is related to the amounts of ink the nozzles 21-1 to **21-*n* of the ink jet head 20 eject. The characteristic value related to the amount of ink ejected by a nozzle is, for example, the diameter of a circle 33 circumscribing the test dot 32 formed by the ink ejected from the nozzle and not contacting the test dot formed by the ink ejected from any other nozzle in the same condition. Hereinafter, the diameter of the circle 33 circumscribing the test dot 32** will be referred to as "dot diameter." "Dot diameter (n)" means the diameter of the dot formed by the nth nozzle.

The recording medium 31 should best be a glossy paper sheet for use in ink jet printers. The characteristic value may be other than the amount of ink ejected, for example either the amount of the ink drop ejected, measured by an optical means, or the area of the test dot 32 formed on the recording medium 31. Moreover, the characteristic value may be the density or brightness of a painted-out image formed on the recording medium 31. Note that a transport means is provided to transport the ink jet head 20 or the recording medium 31. For example, the ink jet head 20 may be held immovable, and the transport means transports the recording medium 31 below the ink jet head 20. In this case, the ink jet head 20 emits ink dots onto the recording medium 31, forming a solid image thereon. Either an optical densitometer or a chromoscope measures the density or brightness of the solid image which is used as characteristic value.

The characteristic value can achieve some effect if it is the diameter of the nozzle (nozzle 21-1, 21-2, . . . or **21-*n***), the resistance or electrostatic capacitance of the actuator or the size of the channel containing ink, or the like, which greatly influences the amount of ink ejected. The density unevenness can be determined from one of these characteristic values, without actually ejecting the ink from the nozzle. Therefore, any one of these characteristic values may be selected in accordance with the degree of density unevenness and can be used to determine the density unevenness.

The characteristic value need not be a single physical quantity. Rather, it may be a weighted average of two or more physical quantities. For example, it may be 4× dot area/dot circumference, i.e., known as hydraulic diameter in the field of hydraulics. This characteristic value is preferable because it is hardly influenced by, for example, the running of ink on the recording medium 31.

In Step M2, the ink jet head 20 performs the filtering process on the characteristic values about all ink amounts, acquired by the characteristic data generation unit 9, thereby accomplishing smoothing.

The filtering process uses a well-known digital filter such as a motion-average, finite impulse response (FIR) filter or an infinite impulse response (IIR) filter. In the filtering process, it is desirable to utilize a low-pass filter that filters out components other than those of special frequency, which are conspicuous to the human eye. The components filtered out are, for example, those that have wavelengths less than or equal to 1 mm. Alternatively, the filtering process may use a high-pass filter that filters out low-frequency components having wavelengths greater than or equal to, for example, 200 mm. Still alternatively, the filtering process may use a band pass filter that is a combination of a low-pass filter and a high-pass filter. The filtering process need not be performed, depending on the method that is employed to acquire the characteristic values.

The filtering process according to the present embodiment uses a low-pass filter that filters out components having wavelengths less than or equal to 1 mm, with respect to the dot diameter that has been selected as characteristic value.

The envelope acquisition unit **10*b* arranges the dot diameters generated by the characteristic data generation unit 9 in the order the nozzles 21-1 to 21-*n* are arranged, as is illustrated in FIG. 6, thus preparing a characteristic graph that shows the relation between the dot diameters, on the one hand, and the positions of the nozzles 21-1 to 21-*n*. From the characteristic graph, the envelope acquisition unit 10*b* acquires two envelopes Ea and Eb that accord with the largest and smallest changes, respectively, the dot diameters undergo at the positions of the nozzles 21-1 to 21-*n*. More specifically, as shown in FIG. 6**, the envelope Ea (hereinafter called "first envelope") is defined by a third-degree spline curve or the like, and pertains to the maximum value, and the envelope Eb (hereinafter called "second envelope") is defined by a third-degree spline curve or the like, and pertains to the minimum value.

In Step M3, the parameter calculation unit **10*c* sets a decision section S for the first envelope Ea or the second envelope Eb acquired in Step M3 and pertaining to the maximum value and minimum value, respectively. The parameter calculation unit 10*c* then scans the decision section S in the direction the nozzles 21-1 to 21-*n*** are arranged in a specific order, calculating a decision parameter from the change the first envelope Ea or second envelope Eb undergoes in the decision section S.

The decision parameter is a parameter used to determine the density unevenness of the ink jet head 20. In the present embodiment, the decision parameter is the largest change observed in the decision section S, of the first envelope Ea or second envelope Eb acquired by the envelope acquisition unit **10*b***.

Figure 8:
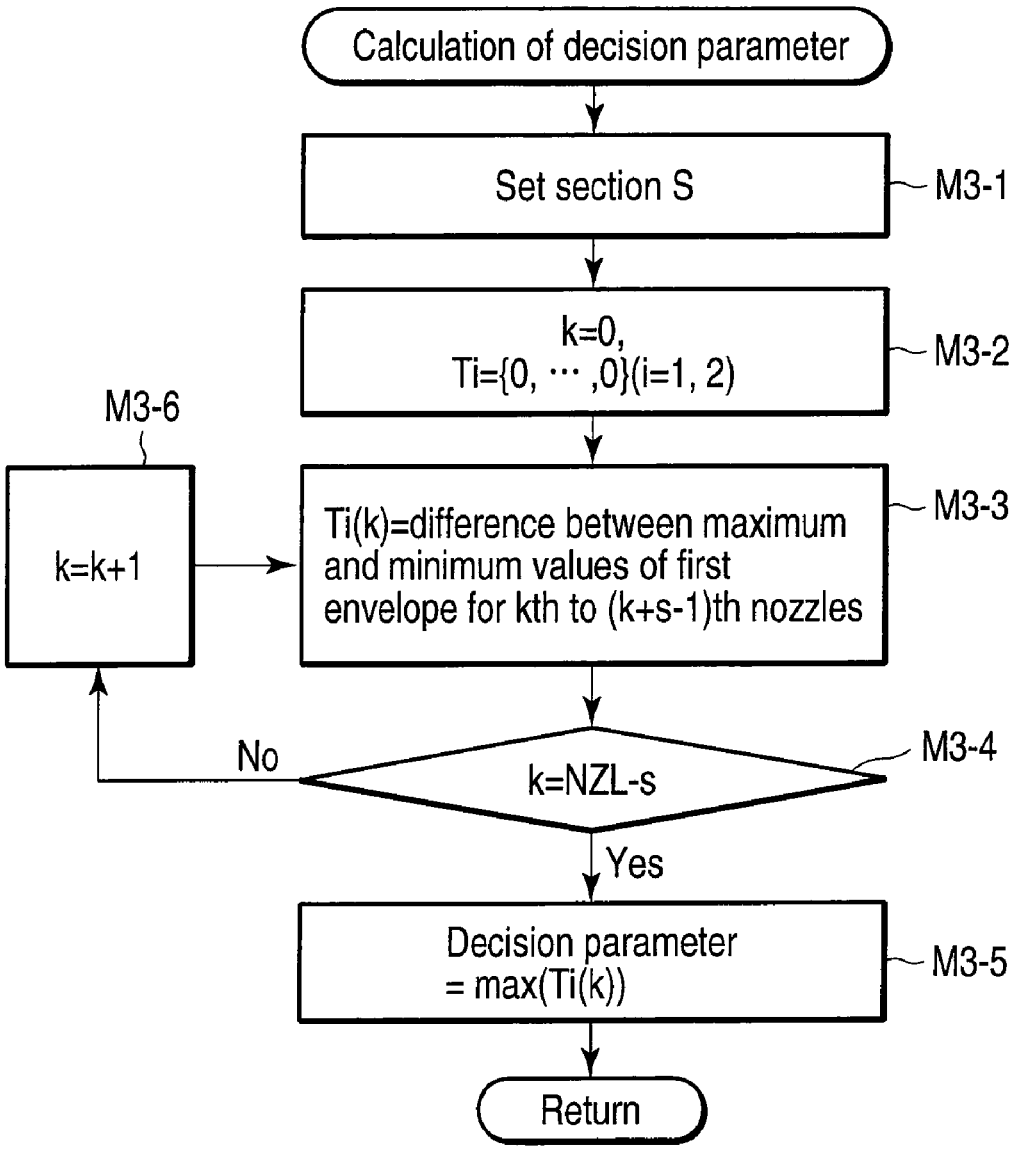
FIG. 8 is a flowchart explaining how the decision parameters are calculated in the embodiment.

How the decision parameter is calculated will be explained with reference to the flowchart of FIG. 8.

In Step M3-1, the parameter calculation unit **10*c* sets the decision section S as shown in FIG. 7. The decision section S is preferably "100," on the assumption that the ink jet head 20 has resolution of, for example, 300 dpi. The decision section S is a natural number not exceeding NZL, i.e., the number of nozzles 21-1 to 21-*n* the ink jet head 20 has. The decision section S is set in order to detect regions in which the first and second envelopes Ea and Eb greatly change. The regions detected are, for example, those in which the test dot 32 formed on the recording medium 31 changes greatly in diameter. If the decision section S is expanded in width, regions where the test dot 32 changes greatly in diameter can be detected in a broader range. Conversely, if the is contracted, the regions where the test dot 32** changes greatly in diameter can be detected in a narrower range.

In Step M3-2, the parameter calculation unit 10*c* initializes value k to "0," and initializes the work array Ti pertaining to the ith envelope to {0, . . . , 0} (Ti={0, . . . , 0}). The elements of Ti are equal, in numbers, to NZL-s+1, where NZL is the number of all nozzles and i is an envelope index. In the present embodiment, two envelopes, i.e., Ea and Eb, exist in the present embodiment, and two work arrays T1 and T2 therefore exist. FIG. 7 shows the second envelope Eb only, and therefore shows the work array T2 pertaining to the second envelope Eb.

In Step M3-3, the parameter calculation unit 10*c* substitutes, for the work array Ti(k), the difference between the maximum and minimum values the ith envelope has for the nozzles of nozzle numbers "k" to "k+s−1." This substitution is performed on both the first envelope Ea (i=1) and the second envelope Eb (i=2).

In Step M3-4, the parameter calculation unit 10*c* determines whether the nozzle number k is NZL−s (k=NZL−s). If Yes, the parameter calculation unit 10*c* goes to Step M3-5. If No, the parameter calculation unit 10*c* goes to Step M3-6.

In Step M3-5, the parameter calculation unit 10*c* substitutes the maximum value for Ti(k) for the decision parameter. In Step M3-5, the parameter calculation unit 10*c* then increases k to k+1, moving the decision section S.

The work array T1 is T2 for the second envelope Eb shown in FIG. 7. The parameter calculation unit 10*c* therefore scans the decision section S, in the range from the nozzle number "k" to the nozzle number "**21-*n*." As the parameter calculation unit 10***c* so scans the decision section S, it calculates the maximum value max and minimum value min of that part of the second envelope Eb, which lies in the decision section S. The parameter calculation unit 10*c* then finds the difference T2(*k*) between the maximum value max and minimum value min, which are in the range of the nozzle numbers "k" to "**21-*n*." Further, the parameter calculation unit 10***c* calculates a decision parameter from the difference T2(*k*) between the maximum value max and minimum value min. In this embodiment, the decision parameter is equivalent to the average change rate of the characteristic value, for the decision section S.

In Step M4, the decision unit 11 compares the decision parameter calculated by the parameter calculation unit 10*c* with the predetermined threshold value, determining the density unevenness of the ink jet head 20.

Figure 9:
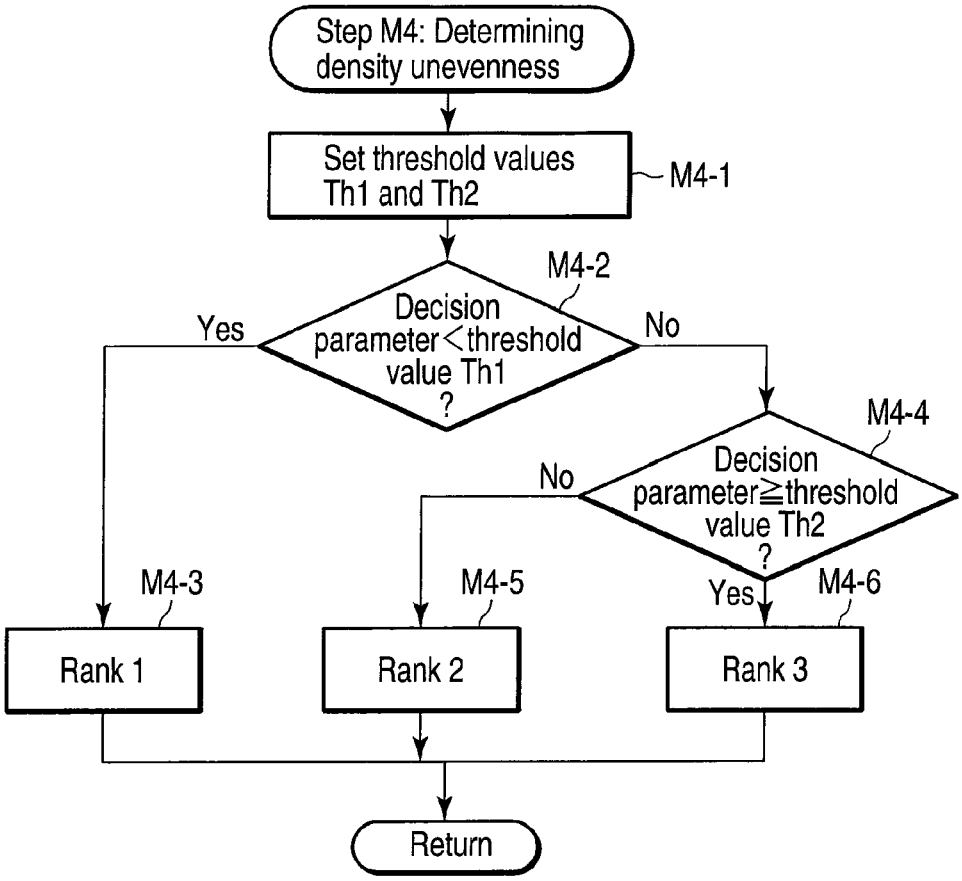
FIG. 9 is a flowchart explaining how the apparatus determines the density unevenness.
Figure 10:
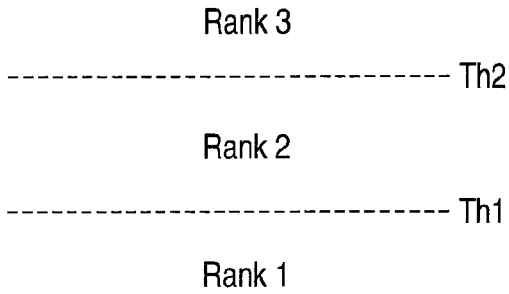
FIG. 10 is a diagram illustrating the relation between the rank of density unevenness and the threshold value.

How the density unevenness of the ink jet head 20 is determined will be explained with reference to the flowchart of FIG. 9. In the present embodiment, three ranks, i.e., rank "1," rank "2" and rank "3," are set to the density unevenness, and the density unevenness is evaluated at rank "1," rank "2" or rank "3."

The algorithm for determining the density unevenness will be described in detail as follows.

In Step M4-1, the decision unit 11 sets threshold values Th1 and Th2. Threshold values Th1 and Th2 are determined from the relation between the decision parameters acquired of a plurality of ink jet heads 20 and, for example, the function evaluation of the solid image printed on a recording medium. Generally, the relation of Th1<Th2 is established. Hence, in the relation between the ranks "1" to "3" of density unevenness and threshold values Th1 and Th2, threshold value Th1 and any threshold value smaller than Th1 are evaluated at rank "1." Any threshold value between threshold values Th1 and Th2 is evaluated at rank "2." Threshold value Th2 and any threshold value larger than Th2 are evaluated at rank "3." Therefore, any ink jet head will be evaluated as a good one even if the decision parameter is less than or equal to threshold value Th1, because the rank of its density unevenness is lower than rank "2" and rank "3."

In Step M4-2, the decision unit 11 determines whether the decision parameter is smaller than threshold value Th1 (decision parameter<threshold value Th1).

If the decision parameter is smaller than threshold value Th1, or if Yes, the decision unit 11 goes to Step M4-3 and determines that the ink jet head 20 is evaluated at rank "1."

If the decision parameter is smaller than threshold value Th1, or if No, the decision unit 11 goes from Step M4-2 to Step M4-4. In Step M4-4, the decision unit 11 determines whether the decision parameter is greater than or equal to threshold value Th2 (decision parameter threshold value Th2).

If the decision parameter is greater than or equal to threshold value Th2, the decision unit 11 determines that the ink jet head 20 is evaluated at rank "2." That is, the decision parameter is somewhere between threshold values Th1 and Th2.

If the decision parameter is not greater than, or equal to, threshold value Th2, the decision unit 11 goes from Step M4-2 to Step M4-6. In Step M4-6, the decision unit 11 determines that the ink jet head 20 is evaluated at rank "3." The decision parameter is therefore greater than or equal to threshold value Th2.

Thus, the characteristic values about ink amounts to be ejected from the nozzles 21-1 to **21-*n* of the ink jet head 20 are acquired for all nozzles 21-1 to 21-*n* in the first embodiment described above. Then, the characteristic values arranged in the order the nozzles 21-1 to 21-*n* are arranged. Next, decision parameters are calculated from the changes the first envelope Ea and second envelope Eb, i.e., arrays of the characteristic values, undergo in the decision section S. The decision parameters are compared with threshold values Th1 and Th2. As a result, the density unevenness specific to the ink jet head 20 is determined. The specific density unevenness can evaluated at, for example, rank "1," rank "2" or rank "3," in accordance with the degree of the density unevenness specific to the ink jet head 20**.

This embodiment can appropriately determine or evaluate the density unevenness of the ink jet head 20, from the large spatial changes in the characteristic values such as dot diameters, as is shown in the flowchart of determining the density unevenness.

The first embodiment described above may be modified as will be described below.

Figure 3:
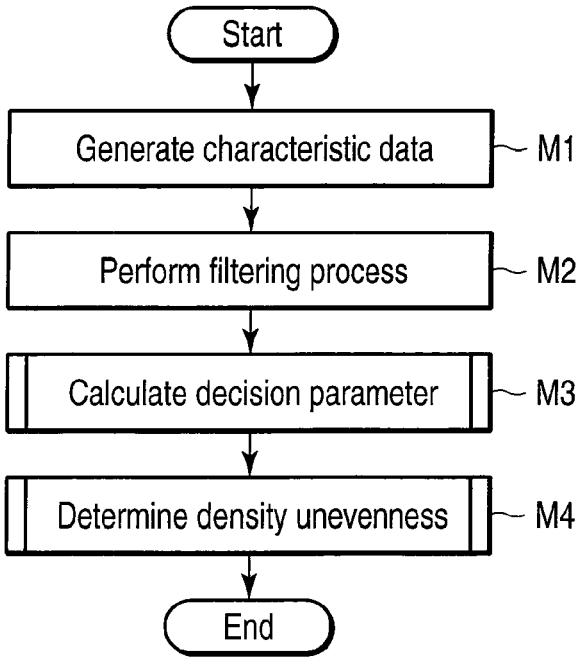
FIG. 3 is a flowchart explaining how the apparatus determines the density unevenness.

In the first embodiment, the density unevenness is determined as shown in FIG. 3. That is, the characteristic value of the ink jet head 20 is generated in Step M1, the characteristic value is subjected to the filtering process in Step M2, a decision parameter is calculated in Step M3 from the characteristic value subjected to the filtering process, and the density unevenness of the ink jet head 20 is determined from the decision parameter. Nonetheless, Steps M1 to M3 need not be so distinctly performed. For example, the characteristic value calculated may be used as a filtering process decision parameter, as well, as in the third embodiment that will be described later.

The first embodiment described above calculates the decision parameter from two types of envelopes, i.e., first envelope Ea and second envelope Eb. The invention is not limited to this. The decision parameter may be calculated by using, for example, the characteristic value that has been subjected to the filtering process.

The first embodiment evaluates the density unevenness at one of three ranks. The number of ranks is not limited "3," nevertheless. The ranks may be set in a different number. Further, the density unevenness may not be ranked at all. In this case, the decision parameter may be used as the result of determining the density unevenness. For example, the density unevenness may be determined directly from the decision parameter, which is used as a score representing the degree of the decision parameter.

The first embodiment calculates the decision parameter from only those parts of the first envelope Ea and second envelope Eb, which change more greatly than any other parts. This invention is not limited to this. For example, the changing parts of the first envelope Ea and second envelope Eb may be ranked in terms of change magnitude, some of the changing parts, which are ranked over a preset range, may be weighted, and the average weight of these parts may be used as decision parameter.

A first modification of the first embodiment of this invention will be described below.

In a method of determining the density unevenness of an ink jet head, according to the first modification of the first embodiment, a plurality of decision sections S having different widths are set, and threshold values are set to the decision sections S, respectively. In Step M3 shown in FIG. 3, the change each characteristic value undergoes in the decision section S on the array of characteristic values is determined. In Step M4, the change thus determined is compared with a threshold value.

The first modification will be described in detail.

In Step M3, one decision parameter is calculated for the density unevenness. Nonetheless, a plurality of decision parameters should better be calculated in Step S3. If the decision sections S have different widths, the different threshold values Th1 are applied to the decision sections S, respectively, in most cases.

Assume that the threshold value Th for a decision section S (=10) is Th1 (=0.5), and that the threshold value Th for a decision section S (=100) is Th1 (=1.0).

If the decision parameter for the decision section S (~100), i.e., the average change rate of dot diameter, is 0.9 at maximum, the density unevenness of the ink jet head 20 will be evaluated at rank "1" (Step M4). This is because the threshold value Th1 (=1.0) is larger than 0.9 (1.0>0.9).

The decision parameter for the decision section S (=10) may be 0.7. In this case, the density unevenness of the ink jet head 20 is evaluated at rank "2," not at rank "1" (Step M4), because the threshold value Th1 (=0.5) is larger than 0.7 (0.5<0.7).

The decision section S (=10) is shorter than the decision section S (=100). The decision parameter for the decision section S (=10), i.e., 0.7, manifests a characteristic value, such as a great change of dot diameter that has occurred in the short section.

In the relatively long decision section S (=100) only, such an abrupt change as occurring in the decision section (=10) cannot be detected at all. Even if the density unevenness is evaluated at rank "1" when the threshold value for the decision section S (=100) is Th1 (=0.6), it may not be evaluated at rank "1" in the decision section S (=10).

Figure 11:
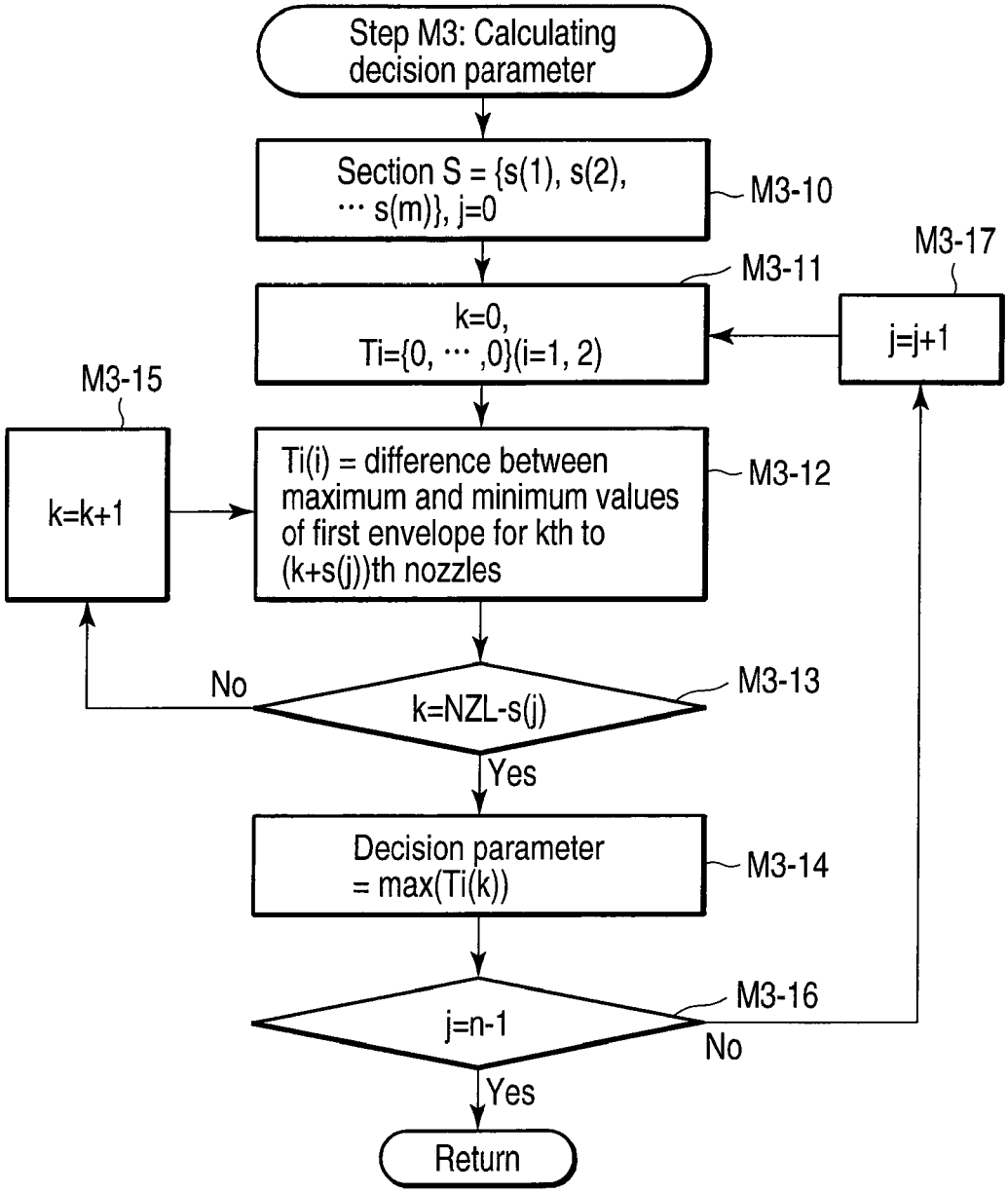
FIG. 11 is a flowchart explaining how the decision parameters are calculated in a first modification of the apparatus according to this invention, which is designed to determine the density unevenness of an ink jet head.
Figure 12:
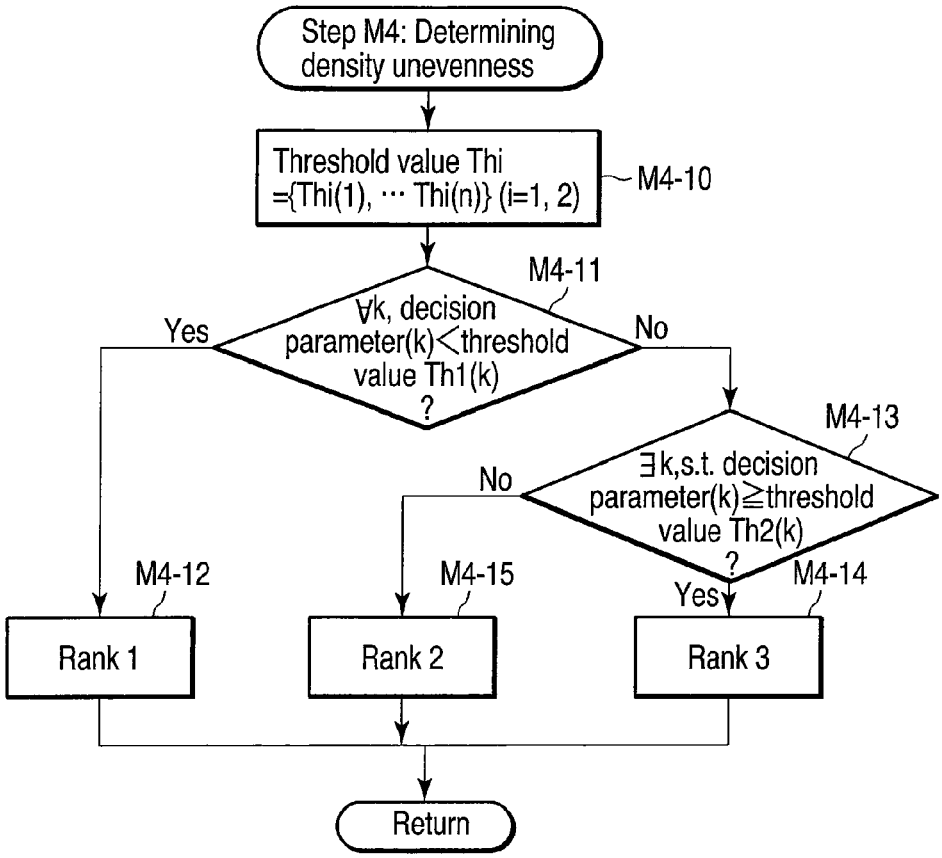
FIG. 12 is a flowchart explaining how the first modification determines the density unevenness.

How to calculate the decision parameter for determining the density unevenness (Step M3) in the case where n decision parameters exists will be explained first with reference to the flowchart of FIG. 11. Next, how to determine the density unevenness of the ink jet head 20 (Step M4) will be explained with reference to the flowchart of FIG. 12.

How the decision parameter for use in determining the density unevenness is calculated will be explained first.

In Step M3-10, the parameter calculation unit 10*c* sets m decision sections S. Five decision sections S may be set if the ink jet head 20 has resolution of 300 dpi. These decision sections S are, for example, S={5, 10, 30, 60, 100}. The greater m is, the better. Nonetheless, five decision sections S set in, for example, a range from 0.5 mm to 10 mm are good enough in most cases. Index J is initialized to "0."

In Step M3-11, the parameter calculation unit 10*c* initializes index k to "0," and initializes the work array Ti pertaining to the ith envelope to {0, . . . , 0}. The work array Ti has as many elements as NZL-s(j)+1. The present embodiment has two envelopes, i.e., first envelope Ea and second envelope Eb. Hence, two threshold values Th (i=1, 2) exist for work arrays T1 and T2, respectively.

In Step M3-12, the parameter calculation unit 10*c* substitutes, for the work array Ti(k), the difference between the maximum and minimum values of the ith envelope for the nozzles having nozzle numbers k to k+s−1. The parameter calculation unit 10*c* performs the substitution for both the first envelope Ea (i=1) and the second envelope Eb (i=2).

In Step M3-13, the parameter calculation unit 10*c* determines whether k=NZL−s(j). If k=NZL−s(j), that is, if Yes, the parameter calculation unit 10*c* goes to Step M3-14. If k≠NZL−s(j), that is, if No, the parameter calculation unit 10*c* goes to Step M3-15.

In Step M3-14, the parameter calculation unit 10*c* substitutes, for the decision parameter (j), the maximum and minimum values for i and k of the work array Ti(k). Then, in Step M3-15, the parameter calculation unit 10*c* increases k to k+1, moving the decision section S. Thereafter, the parameter calculation unit 10*c* returns to Step M3-12.

In Step M3-16, the parameter calculation unit 10*c* determines whether j=n−1. If j=n−1, or if Yes, the parameter calculation unit 10*c* finishes calculating decision parameters. If j≠n−1, or if No, the parameter calculation unit 10*c* returns to Step M3-17. In Step M3-17, the parameter calculation unit 10*c* increases j to j+1, and then returns to Step M3-11.

How the density unevenness is determined will be explained below.

The decision unit 11 determines the degree of density unevenness of the ink jet head 20 on the basis of the decision parameter calculated by the parameter calculation unit 10*c*. The density unevenness is ranked at one of three ranks in the first modification, as in the first embodiment. Thus, the ink jet head 20 is evaluated as best if its density unevenness is set to rank "1," as second best if its density unevenness is set to rank "2," and as worst if its density unevenness is set to rank "1."

In Step M4-10, the decision unit 11 sets threshold values Th1 (={Th(1), Thi(2), . . . , Thi(n)} (i=1, 2). The threshold values Th1(*k*) (k=1 to n) have been determined beforehand, from the relation between the decision parameters for a plurality of ink jet heads 20 and the function evaluation of the solid image printed on a recording medium. The relation of Th1(*k*)<Th2(*k*) (k=1 to n) holds true in most cases.

Figure 13:
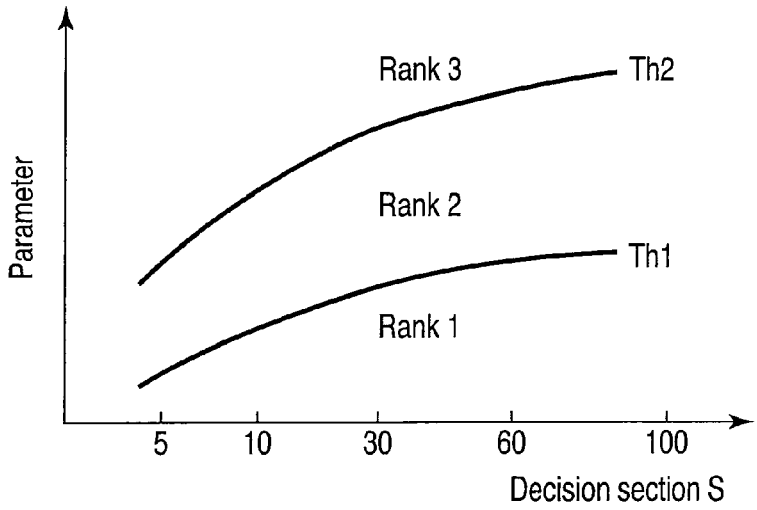
FIG. 13 is a diagram illustrating the relation the ranks of density unevenness have with the threshold values in the first modification.

FIG. 13 illustrates the relation the ranks "1" to "3" of density unevenness have with the decision sections S and threshold values Th1 and Th2 for decision parameters. The decision sections S have been set to different ranges (e.g., 5, 10, 30, 60 and 100). The threshold values Th (i.e., Th1 and Th2) have different values and are set for each decision section S.

In Step M4-11, the decision unit 11 determines whether the decision parameters (k) (<Th1(*k*)) are available for all k. If the decision parameters (k) (<Th1(*k*)) are available for all k, or if Yes, the decision unit 11 goes to Step M4-12. In Step M4-12, the decision unit 11 determines that the jet ink head 20 is evaluated at rank "1," and then terminates the decision sequence.

If the decision parameters (k) (<Th1(*k*)) are not available for all k, or if No, the decision unit 11 goes to Step M4-13 and determines whether any decision parameter (k) that is greater than or equal to Th2(*k*) (k≧Th2(*k*)). If a decision parameter (k) greater than or equal to Th2(*k*) exists, or if Yes, the decision unit 11 goes to Step M4-14 and determines that the ink jet head 20 is evaluated at rank "3," and terminates the decision sequence. If any decision parameter (k) greater than or equal to Th2(*k*) does not exist, or if No, the decision unit 11 goes to Step M4-15 and determines that the ink jet head 20 is evaluated at rank "2," and terminates the decision sequence.

In the first modification of the first embodiment, decision sections S of different widths are set, threshold values Th are set for these decision sections S, respectively, decision parameters are calculated for the respective decision sections S from the changes in the characteristic values manifested on the array of decision parameters, and the decision parameters for the respective decision sections S are compared with the threshold values. The density unevenness of the ink jet head 20 is thereby determined. Thus, the first modification, of course, achieves the same advantages as the first embodiment described above. For example, the first modification can detect the changes in the first and second envelopes Ea and Eb, which occur in relatively short sections, though such changes occurring in the relatively long decision section S (=100) cannot be detected.

A second modification of the first embodiment of this invention will be described below.

In a method of determining the density unevenness of an ink jet head, according to the second modification of the first embodiment, decision parameters are calculated in Step M3 from the changes less than the characteristic values and observed in the associated decision section S, if the envelope cyclically changes on the array of all characteristic values.

Figure 14:
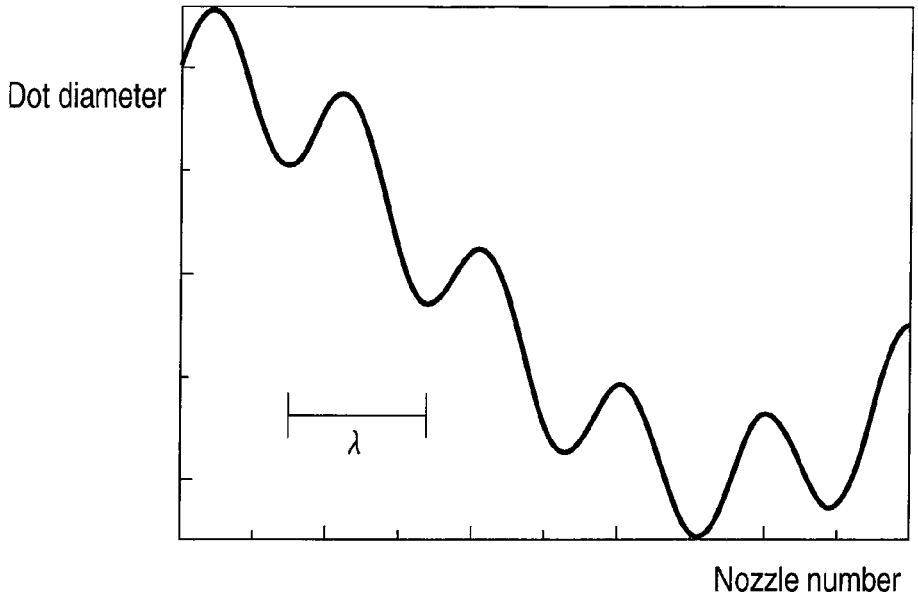
FIG. 14 is a diagram showing a characteristic value indicating a wave of cycle in terms of dot diameter, the value having been acquired by the envelope acquisition unit provided in a second modification of the apparatus according to this invention.

FIG. 14 shows an envelope, or a wave, observed on the array of all characteristic values that accord with the order in which the nozzles 21-1 to 21-*n* of the ink jet head 20 are arranged, e.g., dot diameters (i.e., diameters of the circles 33 circumscribing the test dots 32). As shown in FIG. 14, the dot diameter changes like waves of cycle λ, generally decreasing toward the right little by little. This changing of the dot diameter is too little to be conspicuous to the human eye.

If the dot diameter changes like waves of cycle λ, the density unevenness of cycle λ is determined as follows.

$$\text{Characteristic value}(i)=\Sigma(\text{dot diameter }(i+j\times\lambda))/\Sigma j,$$

where i=1 to λ, and Σ is the sum for j.

Figure 15:
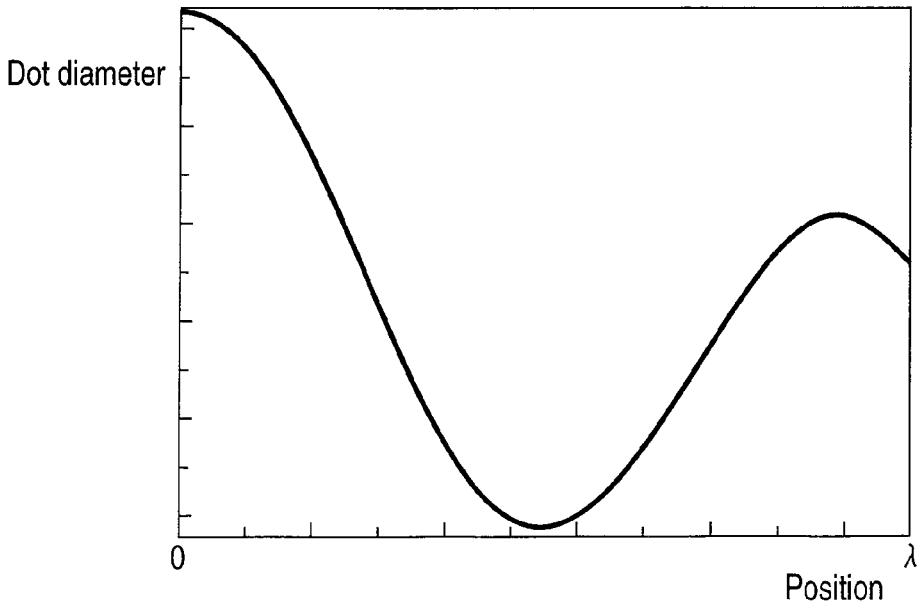
FIG. 15 is a diagram prepared by extracting the waveforms of characteristic values, each lasting for cycle $\lambda$, and then by superimposing these waveforms one on another, and showing how the dot diameter changes within one cycle $\lambda$.

The result of this calculation is as shown in FIG. 15. FIG. 15 has been prepared by extracting the waveforms of the characteristic values shown in FIG. 14, each lasting for cycle λ, and then by superimposing these waveforms one on another. That is, FIG. 14 shows an envelope observed on the array of dot diameters that accord with the order in which the nozzles 21-1 to 21-*n* of the ink jet head 20 are arranged in the order of their numbers. By contrast, FIG. 15 shows how the dot diameter changes within one cycle λ.

The more closely the waves of cycle λ exist, or the larger their amplitudes, the more the envelope of FIG. 15 will undulate, increasing the difference between the maximum and minimum values. If the wave is modulated, waves of cycles, some of which are little shorter than cycle λ, and the others of which are little longer than cycle λ, may be added to the envelope, as follows:

$$\text{Characteristic value}(i)=\Sigma\Sigma(\text{dot diameter }(i+j\times\lambda+k))/(\Sigma j\times\Sigma k)j,$$

where i=1 to, and Σ is the sum for j or k.

If cycle λ is unknown, it may be used as a variable. Cycle λ, may be defined as pertaining to that part of the envelope, which undergoes the largest undulation.

In the second modification, the decision parameter may be, for example, the highest-order coefficient of an approximate curve representing the characteristic value.

The second modification calculates the decision parameter, in Step M3, from the changes less than the characteristic values and observed on the envelope in the decision section S corresponding to the cycle, if the envelope observed on the array of all characteristic values changes cyclically. The second modification can, therefore, determine the cyclic density unevenness more accurately than otherwise.

A second embodiment of this invention will be described below.

In the second embodiment, not only the characteristic values acquired for the respective nozzles 21-1 to 21-*n*, but also the angles at which the nozzles 21-1 to 21-*n* eject ink or the deviations of the ink-landing positions on the recording medium 31 are cumulated in Step M1, thereby calculating characteristic values for the density unevenness of the ink jet head 20.

The first embodiment described above determines the degree of density unevenness from only the characteristic values reflecting the amounts of ink the nozzles 21-1 to 21-*n* of the ink jet head 20 eject. By contrast, this embodiment determines the degree of density unevenness from not only the characteristic values reflecting the amounts of ink, but also the angles at which the nozzles 21-1 to 21-*n* eject ink or the deviations of the ink-landing positions on the recording medium 31.

Figure 16:
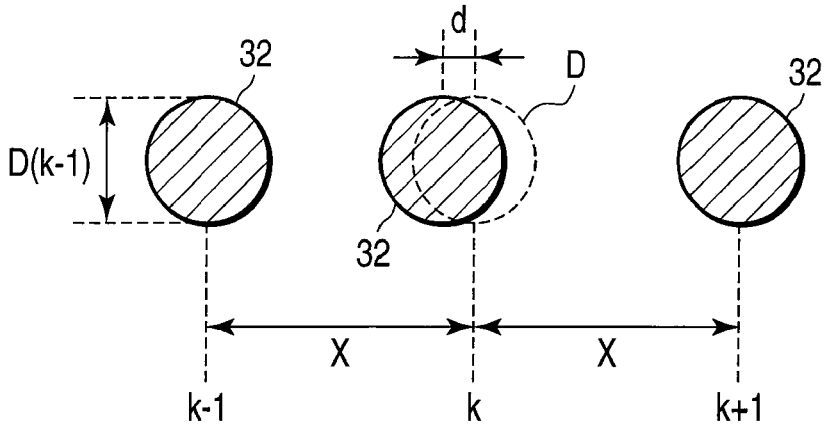
FIG. 16 is a diagram explaining how a characteristic value of the density unevenness of an ink jet printer is generated in an apparatus according to a second embodiment of this invention, which is designed to determine density unevenness.

As shown in FIG. 16, the kth test dot 32 should best be at distance x from an adjacent test dot, i.e., (k−1)th test dot 32, and also at distance x from the other adjacent test dot, i.e., (k+1)th test dot 32. However, the kth test dot 32 may be closer to the (k−1)th test dot 32, deviated by distance d from the ideal position D. In this case, αxd/x and −αxd/x are added to, for example, the −1th characteristic value and the (k+1)th characteristic value, respectively, in the second embodiment. This process serves to evaluate such density unevenness that the density is high where test dots 32 are little spaced from one another and is low where test dots 32 are much spaced from one another.

For example, the rate of sampling characteristic values may be locally changed. That is, the characteristic values once sampled as (nozzle number, characteristic value (nozzle number)) may be re-sampled in the form of (1, characteristic value (1), (2, characteristic value (2)), . . . , (k−1, characteristic value (k−1)), (k−d/x, characteristic value (k)), (k+1, characteristic value (k+1)), . . . , (n, characteristic value (n)).

So configured the second embodiment determines the density unevenness of the ink jet head 20, on the basis of not only the amounts of ink ejected, but also the difference between the nozzles in terms of ink ejection angle. The second embodiment can therefore determine the degree of density unevenness more accurately than otherwise.

A third embodiment of this invention will be described below.

The ink jet head 20 may be of the type that has a plurality of nozzle columns, each column composed of nozzles 21-1 to **21-*n*, and may be designed to apply ink drops emitted from the nozzles of any column land on the recording medium 31**, at the same positions as the ink drops emitted from the nozzles of any other column, thus forming a line-like recording area.

If the ink jet head 20 is this type, the amount of ink emitted from all nozzles of each nozzle column is calculated as a characteristic value in Step M1 of generating the characteristic data representing the density unevenness of the ink jet head 20, and the difference between the characteristic values for the nozzle columns is acquired as a characteristic value.

Figure 17:
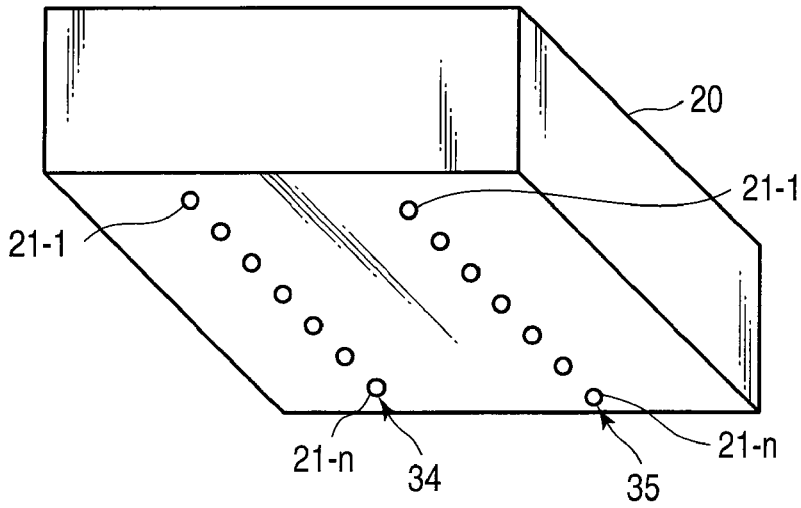
FIG. 17 is a perspective view of an ink jet head which has two nozzle columns for forming two lines in the same recording area of a recording medium, and whose density unevenness is to be determined by an apparatus according to a third embodiment of this invention.

That is, the ink jet head 20 has nozzle columns, each composed of nozzles 21-1 to **21-*n* arranged in a column as illustrated in FIG. 17. More precisely, the ink jet head 20 has two nozzle columns 34 and 35. The ink drops ejected from the nozzles of the nozzle column 34 and the ink drops ejected from the nozzles of the nozzle column 35 land in the same recording area of the recording medium 31. The ink jet head 20 of this type is used to form a high-quality image on the recording medium 31**.

The nozzle columns 34 and 35, each having nozzles 21-1 to **21-*n*, may be driven by one drive unit made of piezoelectric sintered material. In this case, the nozzle columns 34 and 35 eject ink in the same amount in most cases. If this characteristic of the ink jet head is utilized, the characteristic value of density unevenness can be efficiently filtered in Step M2**.

For example, the nozzle columns 34 and 35 of the ink jet head 20 shown in FIG. 17 are so arranged that the nozzles 21-1 to **21-*n* of one column are displaced by half the nozzle interval from the nozzles 21-1 to 21-*n* of the other column, respectively. Therefore, the ink jet head 20** has resolution twice that of an ink jet head that has one column of nozzles.

Figure 5:
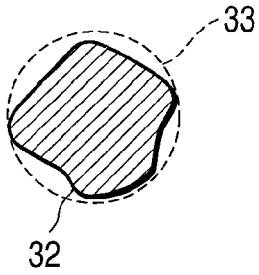
FIG. 5 is a diagram showing exemplary characteristic values related to ink amount, which has been generated by the characteristic data generation unit provided in the apparatus.
Figure 18:
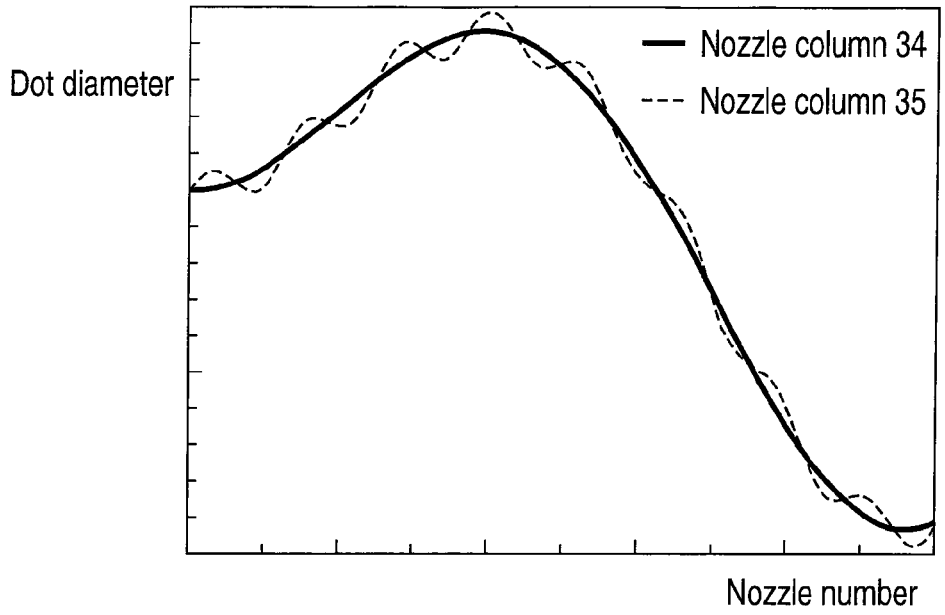
FIG. 18 is a diagram showing a distribution of the diameters of test dots formed by two nozzle columns of the apparatus according to third embodiment.

The actuators provided for each nozzle column (34 or 35) have been made by cutting one piezoelectric element. The nozzle columns 34 and 35 of the ink jet head 20 may be asymmetric to each other, because of the specific structure of the ink jet head 20 or because of the method of forming the nozzle columns 35 and 36. The ink jet head 20 form such test dots 32 as shown in FIG. 5. As seen from FIG. 18, the diameter distribution of test dots 32 is a combination of the diameter distribution of test dots formed by the nozzle column 34 and the diameter distribution of test dots formed by the nozzle column 35. As shown in FIG. 18, the diameter distribution of the dots formed by the nozzle column 34 differs from that of the dots formed by the nozzle column 35, because of the asymmetry resulting from the structure of the ink jet head 20 or from the method of forming the nozzle columns 35 and 36.

Figure 19:
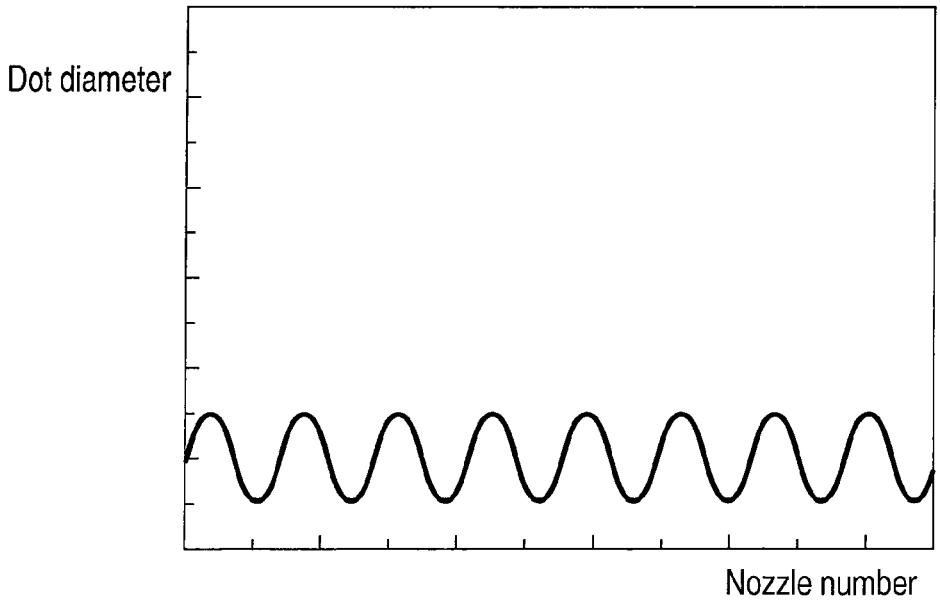
FIG. 19 is a diagram showing a distribution of dot diameters in the apparatus according to the third embodiment, prepared by subtracting the dot-diameter distribution for one nozzle column from the dot-diameter distribution for the other nozzle column.

The short-cycle fluctuation of the diameter distribution of dots formed by the nozzle column 35 is superimposed on the diameter distribution of dots formed by the nozzle column 34, as shown in FIG. 18. The fluctuation therefore reflects the cycle of diameter distribution of dots formed by the nozzle column 35. If the diameter distribution of dots formed by the nozzle column 34 is subtracted from that of dots formed by the nozzle column 35, only the short-cycle fluctuation due to the nozzle column 35 will then appear as shown in FIG. 19. The short-cycle fluctuation due to the nozzle column 35 represents the density unevenness that has resulted from the structure of the ink jet head or the method of forming the nozzle columns. Hence, the filtering process unit **10*a* subtracts the diameter distribution of dots formed by the nozzle column 34 is subtracted from that of dots formed by the nozzle column 35, thereby finding the short-cycle fluctuation due to the nozzle column 35**.

The density unevenness due to the asymmetry resulting from the structure of the ink jet head or the method of forming the nozzle columns may be negligibly small. In this case, it is sufficient to evaluate the density unevenness resulting from only the nozzle column 34 or 35, as in the first embodiment. This is desirable, because half the amount of data involves in calculating the density unevenness.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of determining the density unevenness of an ink jet head, comprising:

calculating characteristic values about ink amounts ejected from all nozzles of the ink jet head, respectively;

arranging the characteristic values in an order in which the nozzles are arranged and calculating a decision parameter based on changes in the characteristic values about those of the nozzles, which exist in a predetermined section; and comparing the decision parameter with a predetermined threshold value, thereby determining the density unevenness of the ink jet head, wherein if changes cyclically appear on an array of all of the characteristic values, the decision parameter is calculated based on changes in fewer than all of the characteristic values, the changes appearing in that part of the array of all of the characteristic values which corresponds to the predetermined section.

2. An apparatus for determining density unevenness of an ink jet head, comprising:

a characteristic data generation unit configured to calculate characteristic values about ink amounts ejected from all nozzles of the ink jet head, respectively;

a decision parameter acquisition unit configured to arrange the characteristic values in an order in which the nozzles are arranged and to calculate a decision parameter based on changes in the characteristic values about those of the nozzles, which exist in a predetermined section; and a decision unit configured to compare the decision parameter with a predetermined threshold value, thereby determining the density unevenness of the ink jet head, wherein if changes cyclically appear on an array of all of the characteristic values, the decision parameter is calculated based on changes in fewer than all of the characteristic values, the changes appearing in that part of the array of all of the characteristic values which corresponds to the predetermined section.

3. The apparatus for determining the density unevenness of the ink jet head, according to claim 2, wherein the decision parameter acquisition unit includes:

a filtering process unit configured to perform a filtering process on all of the characteristic values for achieving smoothing;

an envelope acquisition unit configured to acquire an envelope representing the changes all of the characteristic values undergo after the filtering process; and a parameter calculation unit configured to calculate the decision parameter based on the predetermined section in which the envelope changes greatly.

4. The apparatus for determining the density unevenness of the ink jet head, according to claim 3, wherein the parameter calculation unit calculates, for the predetermined section, the changes in the characteristic values arranged in the order the nozzles are arranged, and then calculates the decision parameter based on a largest change calculated.

5. The apparatus for determining the density unevenness of the ink jet head, according to claim 3, wherein the envelope acquisition unit acquires at least two envelopes, respectively for a maximum change and a minimum change, based on the array of all of the characteristic values.

6. The apparatus for determining the density unevenness of the ink jet head, according to claim 2, wherein:

a plurality of predetermined sections are set, a plurality of threshold values are set for the predetermined sections, respectively, a parameter calculation unit calculates the changes in the characteristic values in each predetermined section, and the decision unit compares each change on the array of the characteristic values with a corresponding threshold value.

7. The apparatus for determining the density unevenness of the ink jet head, according to claim 2, wherein the characteristic data generation unit calculates, in addition to the characteristic values calculated for the nozzles, characteristic values by cumulating angles at which ink is ejected from the nozzles or deviations of ink-landing positions on a recording medium.

8. The apparatus for determining the density unevenness of the ink jet head, according to claim 2, wherein if the ink jet head has a plurality of nozzle columns, each composed of a plurality of nozzles and if ink drops ejected from the nozzle columns land in the same area of a recording medium, the characteristic data generation unit calculates the characteristic values about the ink amount for all nozzles of each column, and acquires a difference in characteristic values between the nozzle columns as final characteristic values.

9. The apparatus for determining the density unevenness of the ink jet head, according to claim 2, wherein the characteristic data generation unit calculates a characteristic value of each nozzle from one data item selected from the group consisting of an ink amount ejected from one nozzle, a diameter of an ink drop to eject from the nozzle, a diameter of an ink dot formed as the ejected ink lands on a recording medium, an area of the ink dot, an optical density of the ink dot, a diameter of the nozzle, a resistance or electrostatic capacitance of an actuator that ejects the ink through the nozzle, and a size of the nozzle.

10. A method of determining density unevenness of an ink jet head, comprising:

calculating characteristic values about ink amounts ejected from all nozzles of the ink jet head, respectively;

arranging the characteristic values in an order in which the nozzles are arranged and calculating a decision parameter based on changes in the characteristic values about those of the nozzles, which exist in a predetermined section; and comparing the decision parameter with a predetermined threshold value, thereby determining the density unevenness of the ink jet head, wherein in addition to calculating the characteristic values for the nozzles, characteristic values are calculated by cumulating angles at which ink is ejected from the nozzles or deviations of ink-landing positions on a recording medium.

11. An apparatus for determining density unevenness of an ink jet head, comprising:

a characteristic data generation unit configured to calculate characteristic values about ink amounts ejected from all nozzles of the ink jet head, respectively;

a decision parameter acquisition unit configured to arrange the characteristic values in an order in which the nozzles are arranged and to calculate a decision parameter based on changes in the characteristic values about those of the nozzles, which exist in a predetermined section; and a decision unit configured to compare the decision parameter with a predetermined threshold value, thereby determining the density unevenness of the ink jet head, wherein the characteristic data generation unit calculates, in addition to the characteristic values calculated for the nozzles, characteristic values by cumulating angles at which ink is ejected from the nozzles or deviations of ink-landing positions on a recording medium.

12. The apparatus for determining the density unevenness of the ink jet head, according to claim 11, wherein the decision parameter acquisition unit includes:

a filtering process unit configured to perform a filtering process on all of the characteristic values for achieving smoothing;

an envelope acquisition unit configured to acquire an envelope representing the changes all of the characteristic values undergo after the filtering process; and a parameter calculation unit configured to calculate the decision parameter based on the predetermined section in which the envelope changes greatly.

13. The apparatus for determining the density unevenness of the ink jet head, according to claim 12, wherein the parameter calculation unit calculates, for the predetermined section, the changes in the characteristic values arranged in the order the nozzles are arranged, and then calculates the decision parameter based on a largest change calculated.

14. The apparatus for determining the density unevenness of the ink jet head, according to claim 12, wherein the envelope acquisition unit acquires at least two envelopes, respectively for a maximum change and a minimum change, based on an array of all of the characteristic values.

15. The apparatus for determining the density unevenness of the ink jet head, according to claim 11, wherein:

a plurality of predetermined sections are set, a plurality of threshold values are set for the predetermined sections, respectively, a parameter calculation unit calculates the changes in the characteristic values in each predetermined section, and the decision unit compares each change on an array of the characteristic values with a corresponding threshold value.

16. The apparatus for determining the density unevenness of the ink jet head, according to claim 11, wherein if changes cyclically appear on an array of all of the characteristic values, the decision parameter is calculated based on changes in fewer than all of the characteristic values, the changes appearing in that part of the array of all of the characteristic values which corresponds to the predetermined section.

17. The apparatus for determining the density unevenness of the ink jet head, according to claim 11, wherein if the ink jet head has a plurality of nozzle columns, each composed of a plurality of nozzles and if ink drops ejected from the nozzle columns land in the same area of a recording medium, the characteristic data generation unit calculates the characteristic values about the ink amount for all nozzles of each column, and acquires a difference in characteristic values between the nozzle columns as final characteristic values.

18. The apparatus for determining the density unevenness of the ink jet head, according to claim 11, wherein the characteristic data generation unit calculates a characteristic value of each nozzle from one data item selected from the group consisting of an ink amount ejected from one nozzle, a diameter of an ink drop to eject from the nozzle, a diameter of an ink dot formed as the ejected ink lands on a recording medium, an area of the ink dot, an optical density of the ink dot, a diameter of the nozzle, a resistance or electrostatic capacitance of an actuator that ejects the ink through the nozzle, and a size of the nozzle.

19. A method of determining density unevenness of an ink jet head, comprising:

calculating characteristic values about ink amounts ejected from all nozzles of the ink jet head, respectively;

arranging the characteristic values in an order of an arrangement of the nozzles;

calculating an envelope corresponding to changes appearing in the arrangement of the characteristic values;

setting a decision section corresponding to a number smaller than a number of all of the characteristic values of the envelope;

scanning the decision section along the order of arrangement of the nozzles;

sequentially calculating a difference between a maximum value and a minimum value of the envelope in the decision section by scanning of the decision section;

calculating a decision parameter based on a largest difference between the maximum value and the minimum value out of the sequentially calculated differences between the maximum value and the minimum value; and comparing the decision parameter with a predetermined threshold value, thereby determining a rank of the density unevenness of the ink jet head.

20. An apparatus for determining density unevenness of an ink jet head, comprising:

a characteristic data generation unit configured to calculate characteristic values about ink amounts ejected from all nozzles of the ink jet head, respectively;

a decision parameter acquisition unit configured to: (i) arrange the characteristic values in an order in which the nozzles are arranged, (ii) calculate an envelope corresponding to changes appearing in the arrangement of the characteristic values, (iii) set a decision section corresponding to a number smaller than a number of all of the characteristic values of the envelope, (iv) scan the decision section along the order of arrangement of the nozzles, (v) sequentially calculate a difference between a maximum value and a minimum value of the envelope in the decision section by scanning the decision section, and (vi) calculate a decision parameter based on a largest difference between the maximum value and minimum value out of the sequentially calculated differences between the maximum value and the minimum value; and a decision unit configured to compare the decision parameter with a predetermined threshold value, thereby determining the density unevenness of the ink jet head.

* * * * *